US007641493B1

(12) United States Patent
Lee

(10) Patent No.: US 7,641,493 B1
(45) Date of Patent: Jan. 5, 2010

(54) WATERPROOF TIGHTENING STRUCTURE FOR A SIGNAL CONNECTOR

(76) Inventor: Chun-Te Lee, No. 61, Taiping Rd., North District, Taichung (TW)

( * ) Notice: Subject to any disclaimer, the term of this patent is extended or adjusted under 35 U.S.C. 154(b) by 0 days.

(21) Appl. No.: 12/208,278

(22) Filed: Sep. 10, 2008

(51) Int. Cl.
*H01R 13/52* (2006.01)

(52) U.S. Cl. ..... 439/271

(58) Field of Classification Search ..... 439/271–275, 439/277, 587
See application file for complete search history.

(56) References Cited

U.S. PATENT DOCUMENTS 4,173,385 A * 11/1979 Fenn et al. ..... 439/277
4,291,932 A * 9/1981 Cox ..... 439/271
6,386,915 B1 * 5/2002 Nelson ..... 439/584
7,354,309 B2 * 4/2008 Palinkas ..... 439/588

* cited by examiner

*Primary Examiner*—Chandrika Prasad
(74) *Attorney, Agent, or Firm*—Ming Chow; Sinorica, LLC

(57) ABSTRACT

A waterproof tightening structure for a signal connecter includes a bolt sleeve bored with a through insert hole provided inside with an annular stop edge formed with an annular holding groove and a first engage surface. A tightening connecter is inserted in the insert hole, and has a flange resisting the stop edge of the bolt sleeve and its second engage surface loosely fixed with the first engage surface. A fixing outer sleeve is secured with the annular projection of the tightening connecter. An elastic waterproof washer is received in an annular recess between the annular projection and the second engage surface and resisted by both the annular holding groove of the bolt sleeve and the front end of the fixing outer sleeve. Thus, the waterproof washer is closely and elastically held by the bolt sleeve, the tightening connecter and the fixing outer sleeve, able to block off moisture.

3 Claims, 5 Drawing Sheets

Replacement Sheet

WATERPROOF TIGHTENING STRUCTURE FOR A SIGNAL CONNECTOR

BACKGROUND OF THE INVENTION

1. Field of the Invention

This invention relates to a waterproof tightening structure for a signal connecter.

2. Description of the Prior Art

A conventional signal connecter, as shown in FIG. 1, includes a bolt sleeve 1, a tightening connecter 2 and a fixing outer sleeve 3 combined together. The tightening connecter 2 is inserted in the interior of the bolt sleeve 1, having its front end formed with a projecting ring 4 to resist against the inner wall of a stop edge 5 which is annularly disposed around the lower outer circumference of the bolt sleeve 1 and protruding toward the hollow center of the bolt sleeve 1. The fixing outer sleeve 3, to be fitted around the outer circumference of the tightening connecter 2 has its front end axially bored with an inner hole 6 to be tightly fitted with the tightening connecter 2. A slot way 7, preset in width, is defined by the rear inner wall of the fixing outer sleeve 3 and the outer circumference of the tightening connecter 2 for receiving a signal wire 100 therein. The signal wire 100 consists of an insulating layer 101, a wire gauze layer 102 wrapped in the insulating layer 101, a foamed core 103 disposed in the center and a guide wire 104 extending out of the center of the foamed core 103. Further, the tightening connecter 2 has an outer edge at its rear section provided with a plurality of ratchet rings 8 for tightly fixing the signal wire 100. The fixing outer sleeve 3 has its rear outer edge disposed with a plurality of circular rings 9 spaced apart. In assembling, the signal wire 100 is first inserted in the slot way 7 of the signal connecter and firmly fitted on the ratchet rings 8 on the rear outer edge of the tightening connecter 2, and then the circular rings 9 on the rear outer surface of the fixing outer sleeve 3 are clamped and compressed by the clamping head of pliers (not shown) to secure the signal wire 100 on the ratchet rings 8 of the tightening connecter 2. At this time, the fixing outer sleeve 3 has its front end closely resisting the rear outer end of the bolt sleeve 1 and tightly fitted with the tightening connecter 2. Thus, the conventional signal connecter is closely assembled to enable the front end of the bolt sleeve 1 connecting to a signal terminal, such as a TV terminal.

However, after the conventional signal connecter is assembled, the bolt sleeve 1 and the projecting ring of the tightening connecter 2 are fixed together only by resisting of the fixing outer sleeve 3; therefore, the bolt sleeve 1 and the tightening connecter 2 are of a loose fit structure and hence a gap still remains between the bolt sleeve 1 and the tightening connecter 2. Thus, when the bolt sleeve 1 is rotated for connecting to a signal terminal, moisture is easily to permeate into the signal connecter through the gap between the bolt sleeve 1 and the tightening connecter 2 to wet the wire gauze layer 102 in the signal wire 100. This will result in signal loss and fading or cause noise interference. As commonly known, there may be thousands of signal connecters used in a network; therefore, so long as one minute part is designed imperfect, the overall situation of the network will be affected.

SUMMARY OF THE INVENTION

The objective of this invention is to provide a waterproof tightening structure for a signal connecter so that, when combined with a signal terminal, the signal connecter can avoid producing any gap among the components to prevent moisture from permeating into the interior and wetting the signal connecter.

The waterproof tightening structure for a signal connecter in the present invention includes a bolt sleeve, a tightening connecter and a fixing outer sleeve. The bolt sleeve is axially bored with a through insert hole provided inside with a stop edge formed with an annular holding groove and a first engage surface. The tightening connecter to be inserted in the insert hole of the bolt sleeve is formed with a flange to resist the stop edge of the bolt sleeve and axially disposed with a gradually-contracted second engage surface to be loosely fixed with the first engage surface of the bolt sleeve. Further, the tightening connecter is formed with an annular projection to be tightly fixed with the fixing outer sleeve, a rear-sectional ratchet member and an annular recess disposed between the annular projection and the second engage surface. An elastic waterproof washer is received in the annular recess of the tightening connecter, having its outer side protruding out of the annular recess to be closely resisted by one end of the annular holding groove at the inner side of the stop edge of the bolt sleeve. The fixing outer sleeve is fitted around the outer circumference of the tightening connecter to push against an outer side of the waterproof washer, with a gap formed between the fixing outer sleeve and the rear end of the bolt sleeve.

With the structure of the present invention, after assembled together, the bolt sleeve, the tightening connecter and the fixing outer sleeve can be closely jointed together by means of the waterproof washer to achieve multiple locking effect. When the bolt sleeve is rotated for connecting to a signal terminal, the stop edge of the bolt sleeve will closely resist the waterproof washer, which can always keep close contact with the stop edge by its expanding elasticity, and the gap kept between the bolt sleeve and the fixing outer sleeve can function to prevent them from interfering with each other. Thus, the signal connecter of this invention can prevent moisture from permeating into the interior through the gap produced among the components.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
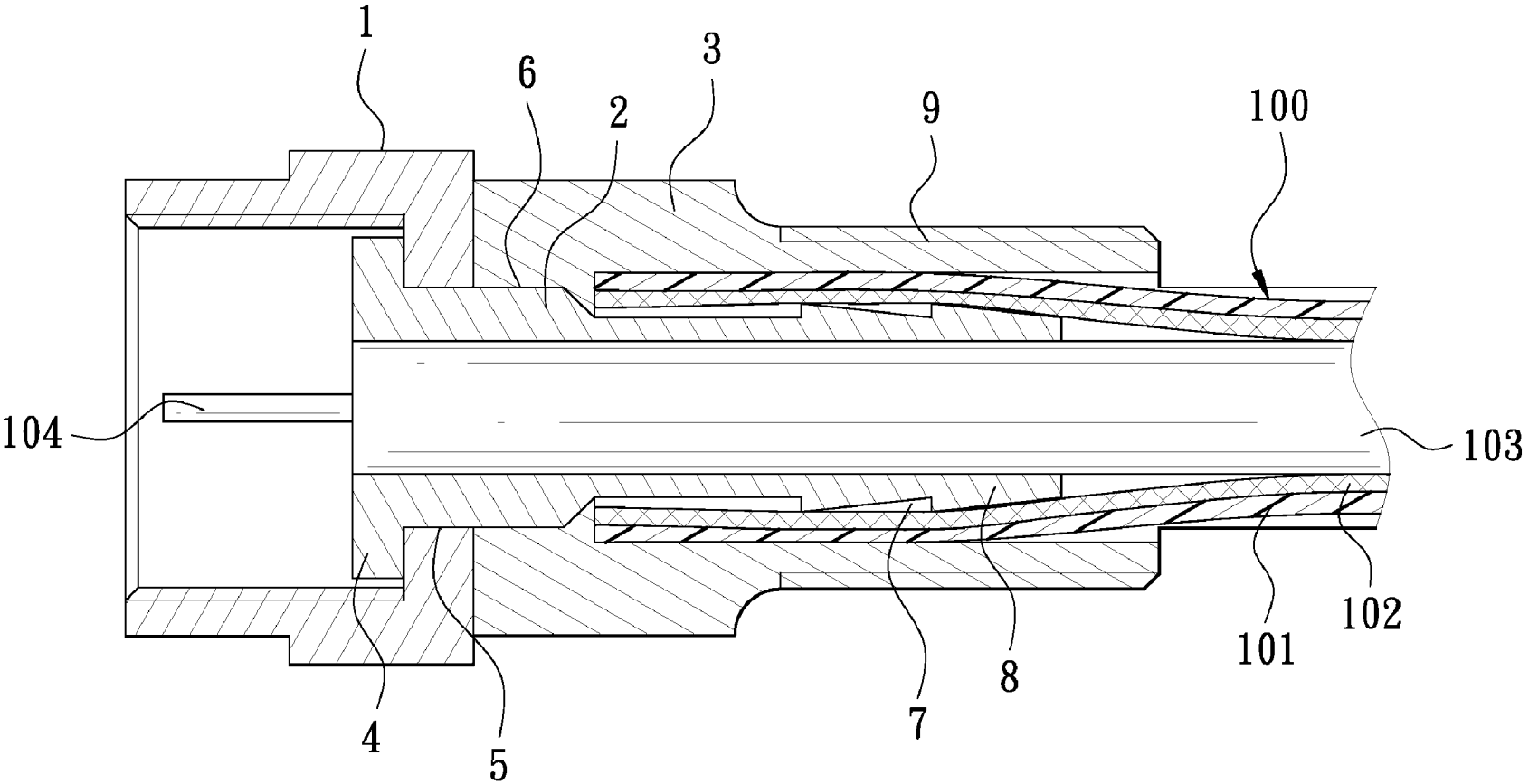
FIG. 1 PRIOR ART
FIG. 1 is a cross-sectional view of a conventional signal connecter.
Figure 2:
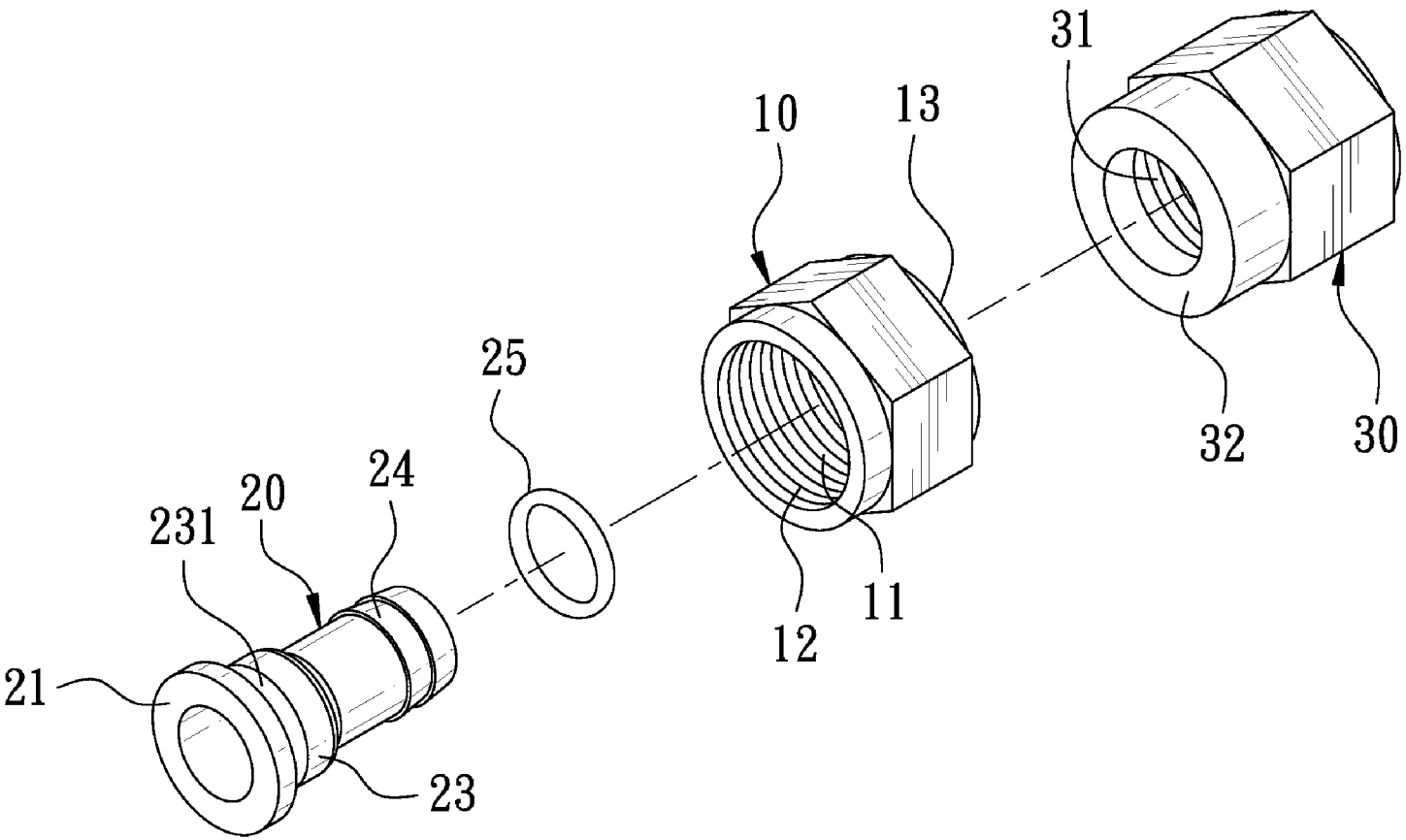
FIG. 2 is an exploded perspective view of a waterproof tightening structure for a signal connecter in the present invention.
Figure 3:
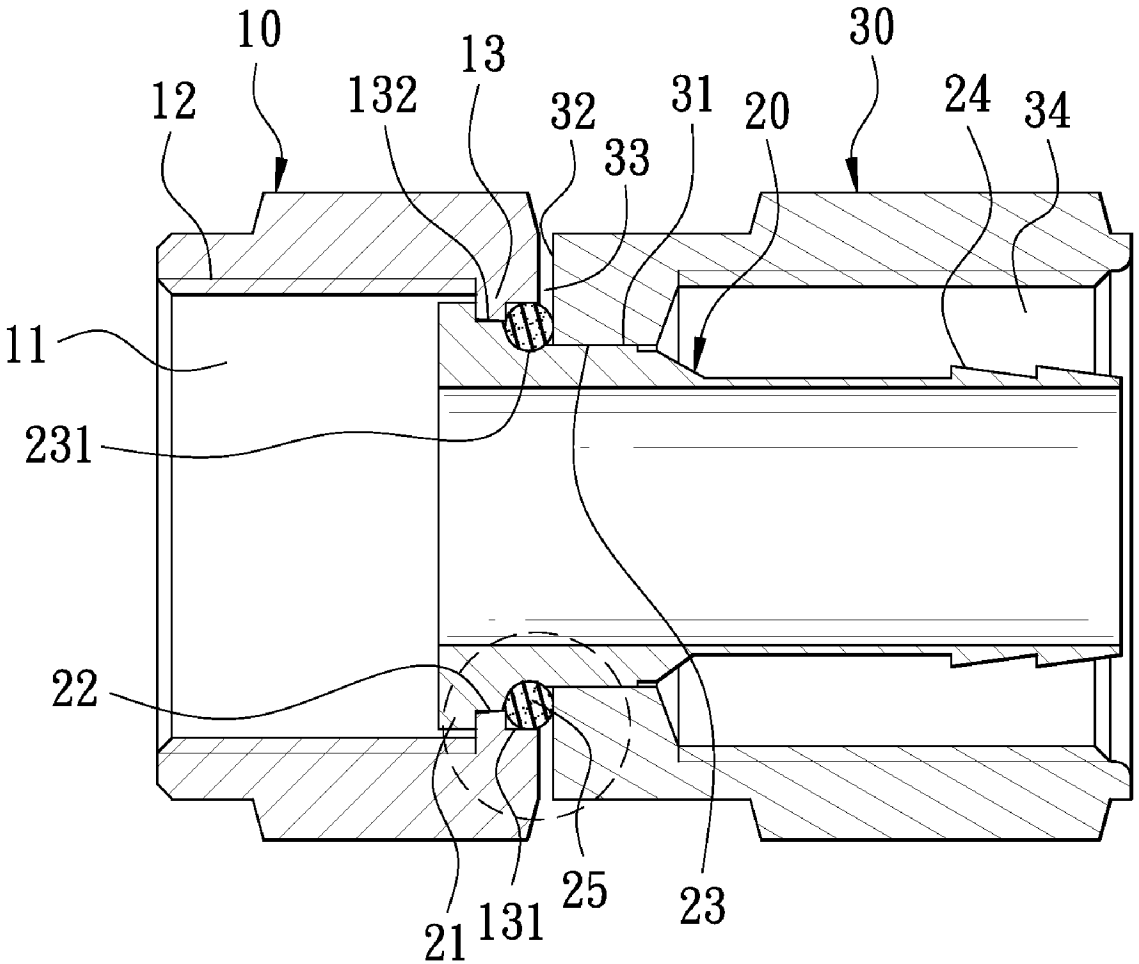
FIG. 3 is a cross-sectional view of the waterproof tightening structure for a signal connecter in the present invention.

A preferred embodiment of a waterproof tightening structure for a signal connecter in the present invention, as shown in FIGS. 2 and 3, includes a bolt sleeve 10, a tightening connecter 20 and a fixing outer sleeve 30 combined together.

Figure 4:
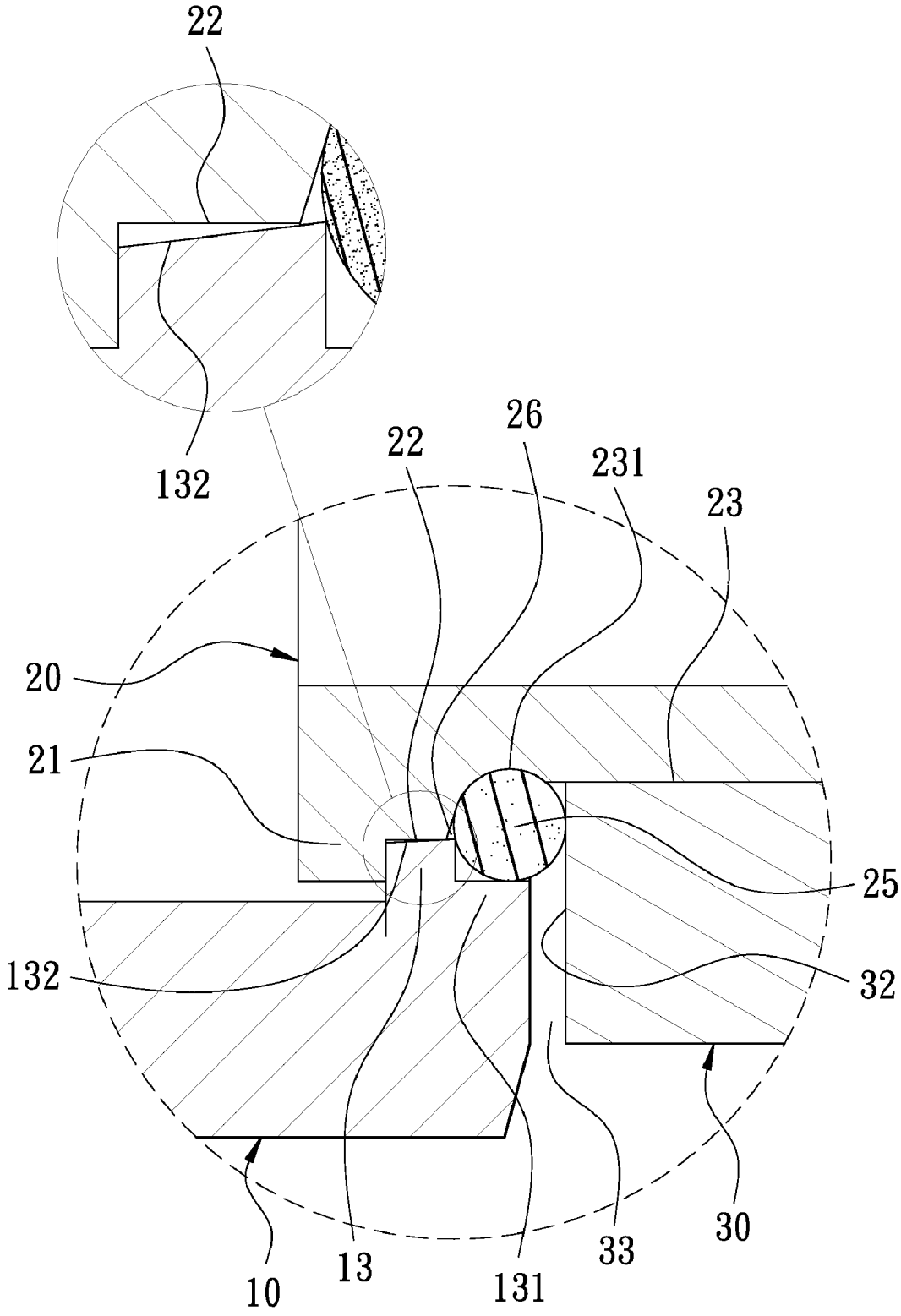
FIG. 4 includes a partial enlarged cross-sectional view of the waterproof tightening structure for a signal connecter in the present invention, and a further enlarged sectional view showing the first engage surface.

The bolt sleeve 10 has its center axially formed with a through insert hole 11 with female threads 12 to enable the front end of the bolt sleeve 10 to be threadably connected with a signal terminal, and its rear inner circumference annularly provided with a stop edge 13 radially protruding toward the center. Referring to FIG. 4, the stop edge 13 is disposed with an annular holding groove 131 at the rear end of the bolt sleeve 10 and has its inner annular side formed with a first engage surface 132, this can be seen in the further enlarged sectional view showing the first engage surface, that is gradually expanded toward the signal terminal to form a conical surface.

The tightening connecter 20 is a hollow cylinder to be inserted in the insert hole 11 of the bolt sleeve 10, having its front end formed with a flange 21 for resisting the front side of the stop edge 13 of the bolt sleeve 10. The flange 21 has one end extending outward radially toward the stop edge 13 of the bolt sleeve 10 and orderly formed with a second engage surface 22 with a comparatively small diameter, an annular projection 23 smaller than the second engage surface 22 in diameter and a rear-sectional ratchet member 24 whose diameter is smaller than the second engage surface 22. Referring to FIG. 4, when the tightening connecter 20 is inserted in the bolt sleeve 10, the outer circumference of the second engage surface 22 of the tightening connecter 20 will correspond with the first engage surface 132 of the bolt sleeve 10, and the second engage surface 22 is restrictedly positioned and engaged on the first engage surface 132, letting the bolt sleeve 10 and the tightening connecter 20 loosely fixed together. Further, an annular recess 231 is formed at a location between the annular projection 23 and the second engage surface 22 of the tightening connecter 22 for receiving an elastically tightening waterproof washer 25, which has its outer side protruding out of the annular recess 231 to be closely resisted by the annular holding groove 131 of the bolt sleeve 10, with an accommodating chamber 26 defined by the waterproof washer 25 and the first engage surface 132 and the second engage surface 22.

The fixing outer sleeve 30 is a hollow cylinder to be fitted around the outer circumference of the tightening connecter 20, having its front end bored with an inner hole 30 to be tightly fitted with the annular projection 23 of the tightening connecter 20. The fixing outer sleeve 30 has the outer side of its front end formed with an annular resisting surface 32 for resisting one outer side of the waterproof washer 25, with a joint gap 33 kept between the front end of the fixing outer sleeve 30 and the rear end of the bolt sleeve 10. An annular slot way 34 with a proper width is formed between the rear inner circumference of the fixing outer sleeve 30 and the outer circumference of the rear ratchet member 24 of the tightening connecter 20 to enable the rear ends of the fixing outer sleeve 30 and the tightening connecter 20 to connect a signal wire 100.

Figure 5:
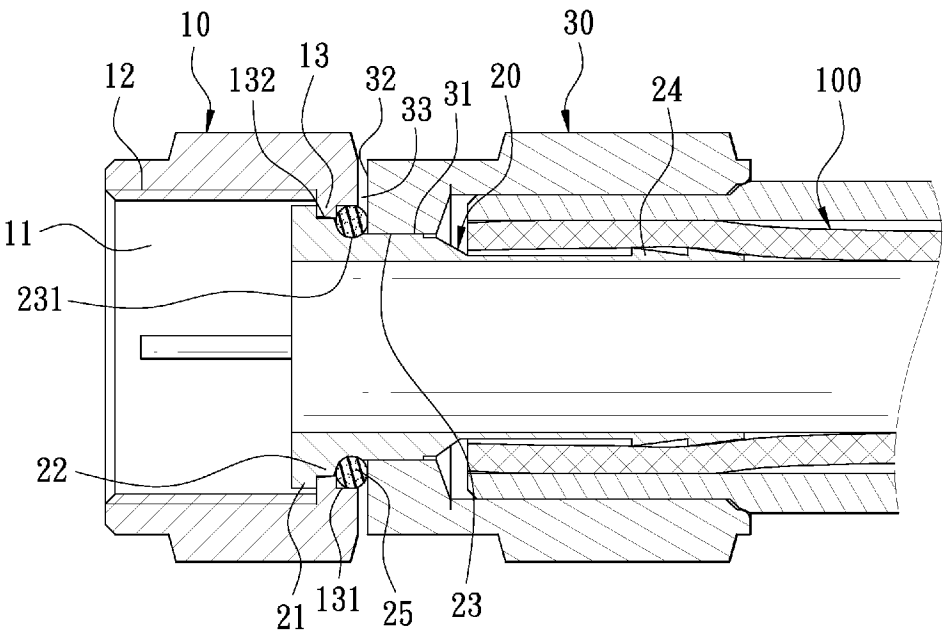
FIG. 5 is a cross-sectional view of the waterproof tightening structure for a signal connecter in the present invention, showing that a signal wire is inserted in the slot way of a tightening connecter.

In assembling, as shown in FIG. 5, firstly, the tightening connecter 20 is inserted through the insert hole 11 of the bolt sleeve 10 to have its projecting ring 21 resisting against the stop edge 13 in the bolt sleeve 10 and its second engage surface 22 restrictedly engaged with the first engage surface 132 of the bolt sleeve 10. Simultaneously, the inner circumference of the annular holding groove 131 of the bolt sleeve 10 will be tightly pressed on the waterproof washer 25 in the annular recess 231 of the tightening connecter 20. Next, the fixing outer sleeve 30 is fitted around the outer circumference of the annular projection 23 of the tightening connecter 20, letting the front outer side of its annular resisting surface 32 resist against the outer side of the waterproof washer 25 and maintaining the gap 33 between the front end of the fixing outer sleeve 30 and the rear end of the bolt sleeve 10. After the inner hole 31 in the front end of the fixing outer sleeve 30 is tightly fitted with the annular projection 23 of the tightening connecter 20, a signal wire 100 can be inserted in the slot way 34 of the signal connecter and fixed on the rear-sectional ratchet member 24 at the rear outer edge of the tightening connecter 20.

By so designing, the signal connecter of this invention has the following advantages.

1. The bolt sleeve 10 has its first engage surface 132 loosely fixed with the tightening connecter 20 so the bolt sleeve 10 can be turned around for threadably connecting a signal terminal, such as a TV connecting terminal.

2. The annular holding groove 131 of the bolt sleeve 10 is diametrically pressed on one side of the waterproof washer 25 received in the annular recess 231 of the tightening connecter 22, and the waterproof washer 25 can closely contact with both the bolt sleeve 10 and the tightening connecter 20 by its expanding elasticity; therefore, no gap will be formed between the bolt sleeve 10 and the tightening connecter 20.

3. The joint gap 33 formed between the bolt sleeve 10 and the fixing outer sleeve 30 prevents them from interfering with each other, and the bolt sleeve 10 and the tightening connecter 20 together with the fixing outer sleeve 30 are closely connected with the waterproof washer 25.

4. The accommodating chamber 26 defined by the waterproof washer 25 and the first engage surface 132 together with the second engage surface 22 functions as an expansion space for the waterproof washer 25 when the waterproof washer 25 is pressed.

While the preferred embodiment of the invention has been described above, it will be recognized and understood that various modifications may be made therein and the appended claims are intended to cover all such modifications that may fall within the spirit and scope on the invention.

I claim:

1. A waterproof tightening structure for a signal connecter comprising, a bolt sleeve;

a tightening connecter;

a fixing outer sleeve;

said bolt sleeve axially bored with a through insert hole in the center;

said bolt sleeve having an inner circumference of one end annularly provided with a stop edge radially protruding toward its center with a first engage surface formed thereon;

said tightening connecter being inserted in said insert hole of said bolt sleeve and stopped and restrictedly positioned by said stop edge to be loosely fitted with said bolt sleeve;

said fixing outer sleeve having its front inner hole tightly fixed with said tightening connecter to let said fixing outer sleeve covering an outer circumference of said tightening connecter;

said tightening connecter formed with a flange to resist against said stop edge of said bolt sleeve;

said tightening connecter extended axially with a gradually dwindling diameter and formed thereon with a second engage surface, an annular projection and a rear-sectional ratchet member;

said tightening connecter diametrically formed with an annular recess at a location abutting said annular projection and said second engage surface;

an elastically tightening waterproof washer received in said annular recess;

said waterproof washer resisting against both said stop edge of said bolt sleeve and a front end of said fixing outer sleeve;

said stop edge of said bolt sleeve being formed with an annular holding groove;

said annular holding groove resisting against said waterproof washer;

said first engage surface formed into a conical surface wherein said first engage surface strictedly fixed with said second engage surface;

said fixing outer sleeve having said inner hole at the rear end thereof being tightly fixed on an outer circumference of said annular projection of said tightening connector; and said tightening connector having waterproof and tightening functions.

2. The waterproof tightening structure for a signal connecter as claimed in claim 1, wherein said waterproof washer is exposed out of said annular recess.

3. The waterproof tightening structure for a signal connecter as claimed in claim 1, wherein an accommodating chamber is defined by said waterproof washer and said first engage surface of said bolt sleeve together with said second engage surface of said tightening connecter.

* * * * *